United States Patent [19]

Urban et al.

[11] Patent Number: 4,501,356

[45] Date of Patent: Feb. 26, 1985

[54] SLIP SEAL JOINT FOR STRAP

[75] Inventors: Clement A. Urban, Willow Springs; Gale W. Huson, Glenview, both of Ill.

[73] Assignee: Signode Corporation, Glenview, Ill.

[21] Appl. No.: 454,256

[22] Filed: Dec. 29, 1982

[51] Int. Cl.[3] ..... B65D 71/00; B65D 63/08; B65D 63/16

[52] U.S. Cl. ..... 206/83.5; 428/57; 24/23 W

[58] Field of Search ..... 428/57; 24/23 W, 23 B, 24/22; 206/83.5

[56] References Cited

U.S. PATENT DOCUMENTS 2,053,739 9/1936 Prindle ..... 24/23 W
3,921,799 8/1979 Beach et al. .

OTHER PUBLICATIONS

Pages 1, 7, 10 & 11 and cover sheet of Catalog-26 entitled, "Signode Systems" ©1974, Signode Corporation, 2600 N. Western Ave., Chicago, Ill. 60647.

Title page and pp. 52 and 53 of Circular 736, U.S. Department of Agriculture entitled, "The Packaging of American Cotton and Methods for Improvement", 1945.

Operation and Safety Manual entitled, "Signode, Model M361, Power Strapping Machine", Signode Corporation, 3600 West Lake Avenue, Glenview, Ill. 60025, (E-186177 8/81—1500).

*Primary Examiner*—Alexander S. Thomas

*Attorney, Agent, or Firm*—Dressler, Goldsmith, Shore, Sutker & Milnamow, Ltd.

[57] ABSTRACT

A strap seal joint and method for applying a seal to the overlapping ends of a strap about a bale of resilient material are disclosed. The bale is initially restrained against expansion in a press. The strap is provided with two oppositely facing major side surfaces having predetermined frictional characteristics. The strap is looped around the bale to overlap inner and outer and end portions of the strap. The seal is applied to the overlapping end portions of the strap. The seal and one of the strap end portions are in an interlocking engagement sufficient to prevent withdrawal of the strap end portion from the closed seal. The seal is also crimped against the other strap end protion with a predetermined degree of frictional force engagement which is sufficiently great, in combination with other frictional forces acting on the strap, to at least initially restrain the strap other end portion relative to the seal at least until the press is opened but which is sufficiently low to permit relative movement between the overlapping strap end portions when the tension force on the strap exceeds a predetermined tension force.

1 Claim, 10 Drawing Figures

FIG. 1
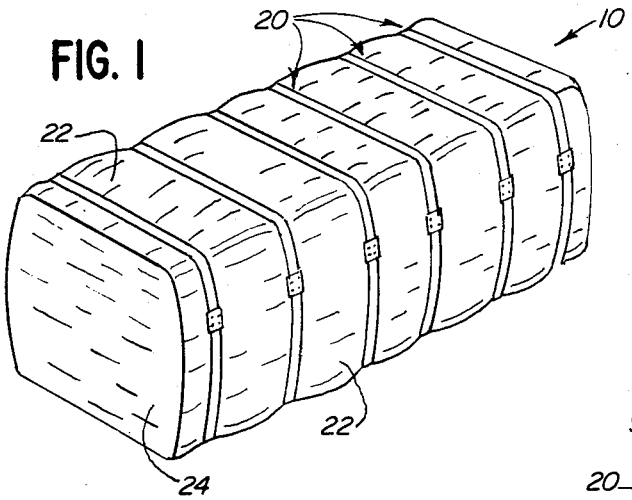
FIG. 3
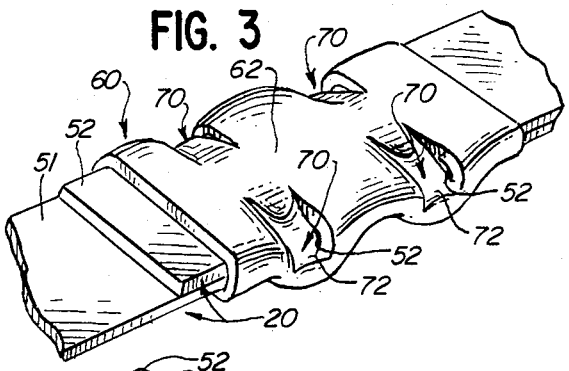
FIG. 4
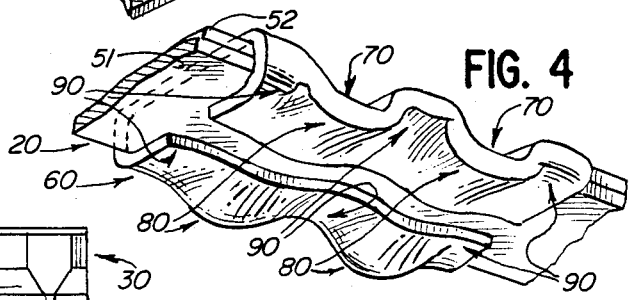
FIG. 2
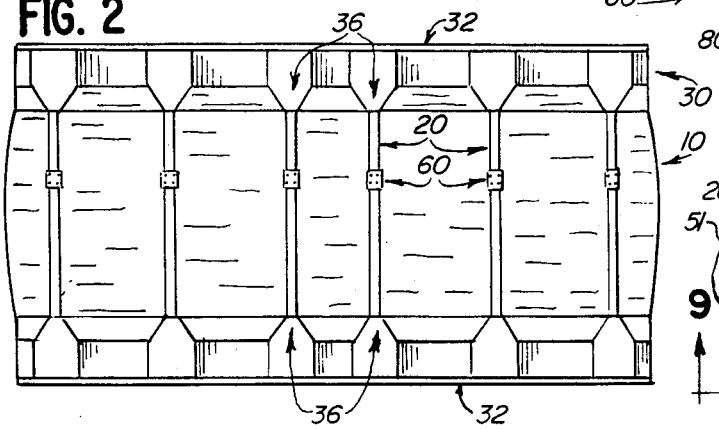
FIG.5
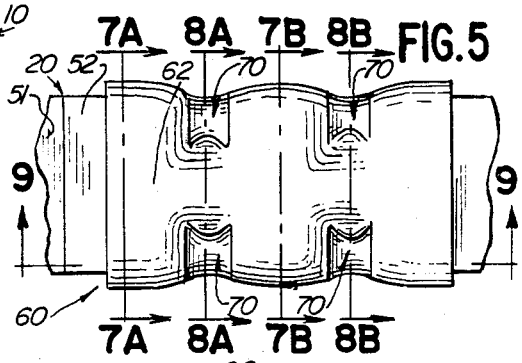
FIG. 7
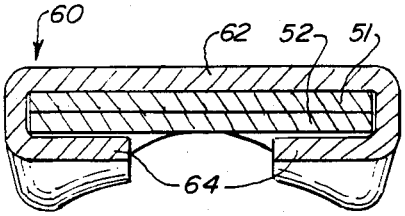
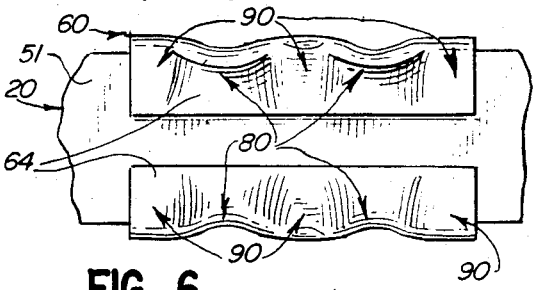
FIG. 6
FIG. 8
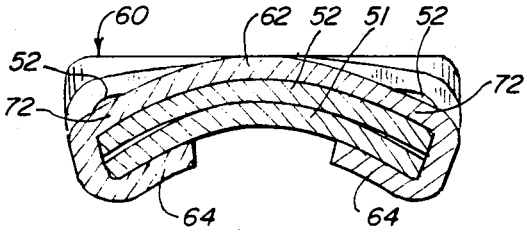
FIG. 9
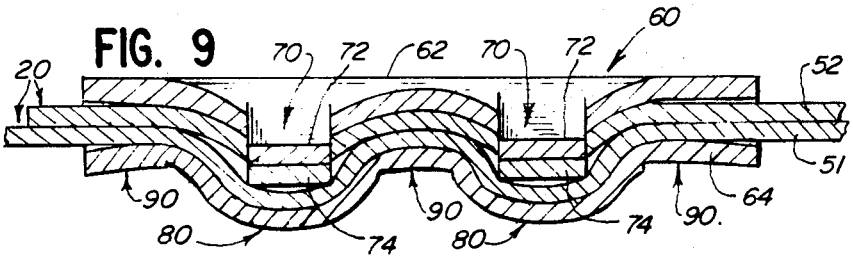
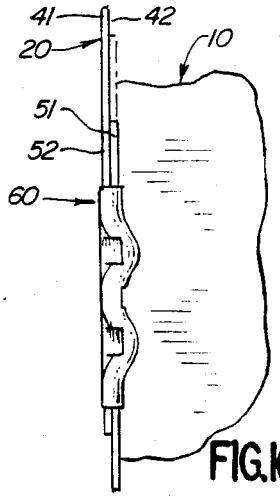
FIG.10

SLIP SEAL JOINT FOR STRAP

CROSS REFERENCE TO RELATED APPLICATION

A method for strapping a bale of resilient material with a strap and a crimped seal connection of the overlapping end portions of the strap which permits some slippage under certain circumstances are disclosed in the concurrently filed and commonly assigned patent application of Gale W. Huson entitled, "SLIP SEAL JOINT FOR STRAP", Ser. No. 454,257, now U.S. Pat. No. 4,466,535.

TECHNICAL FIELD

This invention relates to a connection or joint in a strap around resilient material and to a method for forming such a connection.

BACKGROUND OF THE INVENTION

The present invention is directed to retaining natural and synthetic fibers and other resilient material in bales, and it is intended to be especially useful in the cotton industry for maintaining cotton in bales of a desired shape and size, such as, for example, the widely used "Universal Density38 bales.

Typically, a plurality of metal straps (called "bale ties") are looped around a bale of cotton at spaced-apart locations and the overlapping strap ends are secured to retain the bale at the desired density and shape. It is desirable that the bale ties, and the means for securing the overlapping ends of the bale ties, have the capability for (1) accommodating efficient and safe application to the cotton bale which imposes tension forces on the ties and (2) maintaining their integrity during the subsequent handling and transporation of the bale.

One conventional means for securing the overlapping ends of a bale tie employs a metal seal that is deformed about the overlapping ends of the metal strap comprising the bale tie. Examples of some types of metal seals used for cotton bale ties are disclosed in the U.S. Pat. No. 3,921,799 which is assigned to the assignee of the present invention. One widely used type of metal seal has a crown portion and a pair of opposed side flanges or legs. The legs are adapted to be deformed about the overlapping end portions of the strap so as to cause the overlapping strap end portions to be held in surface-to-surface engagement between the seal crown and the seal legs.

A conventional approach to applying such a seal includes notching or cutting into the seal as well as into the two overlapping strap end portions while displacing or offsetting portions of the strap relative to portions of the seal.

In an alternative approach, the seal is crimped but not notched or cut, whereby slipping or yielding can occur at the seal.

To ensure that the strap and seal on a bale do not break or become loose, the strap, the seal, and the engagement of the strap and seal must be designed to accommodate some selected maximum loading condition. It is difficult to select the maximum design strength of the assembled system of the strap and seal (in place on a bale) since the density to which the bale is compressed is not controlled by the designer of the strap and seal. Further, the designer of the strap and seal does not control the handling and storage of the strapped bale which may subject the bale to unexpectedly high impact or environmental loads.

As a result of these problems, the designer of a strap and seal system may attempt to "overdesign" the system to accommodate those very high continuous and/or transient loads which may affect only a relatively small percentage of the bales. Even with such overdesign, a bale in the field may be subjected to certain loading combinations which can cause failure of one or more of the straps and/or seals on the bale.

Accordingly, it would be desirable to provide a means for securing overlapping end portions of a bale tie or strap around a compressed bale so as to have the capability for accommodating overload conditions. Further, it would be desirable to provide an efficient and relatively simple method for so strapping a bale to accommodate such overload conditions.

It would also be advantageous to reduce, if not eliminate all together, the likelihood of catastrophic failure of the strap and/or seal. In some applications, it may also be beneficial to secure the seal so as to provide a positive interlocking of the seal to part of the strap to ensure that the seal remains on the strap and to ensure that an end portion of the strap will not be pulled out of the seal.

SUMMARY OF THE INVENTION

A seal joint for a loop of strap around a bale of compressed material and a method for applying the strap and seal in a combination around the bale are disclosed herein. The material is initially compressed, as in a press, into a bale shape. At least one strap is disposed in a loop around the restrained bale with the strap end portions overlapping.

A seal is deformed about both of the overlapping strap end portions to close the seal. The step of deforming the seal preferably includes the steps of (1) notching a region of one part of the seal and of one strap end portion to effect an interlocking engagement sufficient to prevent withdrawal of the one strap end portion from the closed seal, and (2) crimping the other part of the seal against the other strap end portion with a predetermined degree of frictional force engagement. The predetermined degree of frictional force engagement is sufficiently low, in combination with other frictional forces acting on the strap, to permit relative movement between the overlapping strap end portions when the tension force on the strap exceeds a predetermined tension force and is sufficiently great to prevent such relative movement when the imposed tension force on the strap is less than or equal to the predetermined tension force.

Alternatively, the seal may be provided with a grit surface or with a knurled or similar surface, or the seal and one strap end portion may be mechanically deformed—each of these alternatives being effected as may be necessary so that the seal and the one strap end portion positively interlock when the seal is closed about the overlapping strap end portions.

The seal joint permits relative movement of the overlapping strap ends when the strap is subjected to excessive forces so that the strap will be better able to accommodate the application of such excessive forces without breaking or causing failure of the seal. Thus, the likelihood of catastrophic failure of the strap and/or seal is reduced, if not eliminated all together.

Numerous other features of the disclosed strapping method and seal joint will be apparent from the following detailed description and accompanying drawings.

BRIEF DESCRIPTION OF THE DRAWINGS

FIG. 1 is a perspective view of material retained in a bale by a plurality of straps secured with the seal joint disclosed herein;

FIG. 2 is a simplified, side view of the strapped bale of FIG. 1 shown just prior to being removed from a closed press (the conventional press structure, other than the illustrated follower block weldments, being omitted);

FIG. 3 is an enlarged, fragmentary, perspective view showing the closed seal on the strap from the top or outer side of the closed seal;

FIG. 4 is an enlarged, fragmentary, perspective view showing the closed seal on the strap from the underside or bottom of the closed seal;

FIG. 5 is an enlarged, fragmentary view of the outer side or top of the closed seal on the strap;

FIG. 6 is an enlarged view of the underside or bottom of the closed seal on the strap;

FIG. 7 is a greatly enlarged, cross-sectional view taken generally along the plane 7A—7A or 7B—7B in FIG. 5;

FIG. 8 is a greatly enlarged, cross-sectional view taken generally along the plane 8A—8A or 8B—8B in FIG. 5;

FIG. 9 is a greatly enlarged, fragmentary, cross-sectional view taken generally along the plane 9—9 in FIG. 5; and FIG. 10 is an enlarged, fragmentary, side view of the strap and seal disposed adjacent the bale and showing relative movement between the overlapping strap ends.

DESCRIPTION OF THE PREFERRED EMBODIMENT

The specification and accompanying drawings disclose one specific form as an example of the use of the invention. The invention is not intended to be limited to the embodiment illustrated, and the scope of the invention is pointed out in the appended claims.

A package or bale 10 of compressed material is illustrated in FIG. 1. The material, which may include any resilient material suitable for baling (such as cotton, hay, tobacco, and the like), is retained in the bale 10 by a plurality of bale ties or straps 20. The bale 10 typically has a prism or parallelpiped shape with four side surfaces 22 and two oppositely facing end surfaces 24. However, the invention may be used with bales of other shapes. The present invention contemplates that the material in the bale 10 is, or can be, sufficiently compressed so that the bale 10 tends to expand outwardly in at least in one direction of expansion.

FIG. 2 illustrates the bale 10 being formed in a suitable baling press 30. The press 30 may be used to initially form the bale 10 from unbaled material or may be used to form the bale 10 from a larger, low density bale (not illustrated). In any case, the press 30 includes conventional mechanisms known to those skilled in the art and which are not illustrated or described here except for the follower block weldments 32.

The weldments 32 are pressed into engagement with oppositely facing side surfaces of the bale 10 by suitable conventional mechanisms. The weldments 32 define generally V-shaped access regions, channels, or chutes 36 through which the straps 20 are passed as the straps 20 are positioned around the bale 10. The straps 20 may be disposed about the bale 10 somewhat loosely by hand or snugly with suitable conventional automatic apparatus known to those skilled in that art. The straps 20 may be nonuniformly spaced along the bale as illustrated in accordance with conventional practice to accommodate the bale expansion forces and retain the bale in the desired shape.

The bale 10 is initially compressed and restrained in the press 30 against expansion at a first nominal density as illustrated in FIG. 2 to permit the application of the straps 20 to the bale. When the press 30 is opened, the bale 10 expands somewhat—depending on how snugly the straps 20 were applied—to a second nominal density which would necessarily be somewhat less than the first nominal density.

If the straps 20 had been initially applied to the bale 10 relatively snugly, then the actual expansion of the bale 10 may be minimal and the density decrease will not be significant. However, the bale 10 will, of course, exert expansion forces on the straps 20 in either case. As explained in detail hereinafter, the straps 20 are secured by means to retain the bale at the desired shape and size in a way that will also accommodate excessive transient loads.

Each strap 20, as best illustrated in FIG. 10, has two oppositely facing major side surfaces 41 and 42. The side surfaces 41 and 42 have known or predetermined frictional characteristics. The strap 20 is disposed in a loop around the bale 10 so that the strap end portions overlap—preferably so as to overlap an inner end portion 51 of the strap adjacent the bale 10 with an outer end portion 52 of the strap.

An open seal 60 is provided for being applied to the overlapping end portions 51 and 52 of the strap 20. The seal 60 has a crown 62 adapted to be disposed adjacent one of the overlapping strap portions (e.g., the strap outer end portion 52 as illustrated in FIG. 3) and has a pair of flanges or legs 64 adapted to be disposed adjacent the other of the strap end portions (e.g., the strap inner end portion 51 as illustrated in FIGS. 4 and 6–9).

The seal 60 is initially provided in an "open" orientation (not illustrated) wherein the legs 64 are not bent inwardly as illustrated in FIG. 4 but instead project outwardly from, and at an angle to, the crown 62 by an amount sufficient to permit the seal 60 to be initially disposed against the overlapping strap portions. Subsequently, the seal legs 64 are closed about the overlapping strap portions as will be described hereinafter in detail.

Although not illustrated, the crown 62 may be disposed against the strap inner end portion 51 so that the legs 64 can be subsequently deformed against the strap outer end portion 52. However, the difficulties in applying the seal 60 with the crown 62 between the strap inner end portion 52 and the bale 10—and the disadvantages of such an orientation—are apparent. Hence, conventional techniques for applying seals to strap typically move the seal into position from the outside of the strap loop so that the crown 62 is initially disposed adjacent the strap outer end portion 52 and so that the legs 64 can be deformed around the strap inner end portion 51. It is contemplated that the present invention is also most easily effected by initially positioning the seal 60 on the strap in the same manner.

It is not necessary that the seal 60 have the precise structure described above. It is sufficient that the seal 60 have one part adapted to be disposed adjacent one of the overlapping strap end portions and at least another part adapted to be deformed adjacent the other of the overlapping strap end portions. The step of deforming the seal 60 preferably includes notching (with one or more notches) a region of one strap end portion and at least the adjacent part of the seal 60 to effect an interlocking engagement of the strap end and seal. In any event, a positively interlocking engagement of one strap end portion and the seal is contemplated by this invention. Such a positive interlocking engagement may also be provided without notching by the use of suitable grit surfaces, knurled surfaces, abutment surfaces, or other similar surfaces.

The interlocking engagement is sufficient to prevent withdrawal of the one strap end portion from the closed seal 60. The step of deforming the seal 60 also includes the step of crimping (with one or more crimps) the other part of the seal 60 against the other strap end portion. In the preferred method of applying the seal, the crown 62 of the seal and the strap outer end portion 52 are notched while the legs 64 are crimped against the strap inner end portion 51.

As best illustrated in FIGS. 3 and 9, the margins of the seal crown 62 are deformed into notches 70 at two spaced locations or regions along each side of the seal 60. Each notch 70 includes in a downwardly slanted wall 72 of the seal 60 which is displaced or offset relative to the remaining portion of the seal crown 62. As best illustrated in FIG. 9, each notch 70 also extends into the strap outer end portion 52 and defines an offset wall 74 in that strap outer end portion 52. As best illustrated in FIG. 9, the notch 70 is formed so that each offset wall 72 of the seal 60 is located between the severed ends of the strap outer end portion 52 that define each side of the notch 70. This effects an interlocking engagement sufficient to prevent withdrawal of the strap outer end portion 52 from the closed seal 60.

FIGS. 4 and 7–9 best illustrate how the seal legs 64 are crimped against the strap inner end portion 51. Both the strap inner end portion 51 and the seal legs 64 bulge outwardly in somewhat convex configurations 80 (FIGS. 4 and 9) which are each generally in registry with a notch 70. Each seal leg 64 may also define generally flat regions 90 adjacent the bulges 80.

The crimped structure of the seal 60 and of the strap inner end portion 51 provides a predetermined degree of frictional force engagement which is sufficiently great, in combination with other frictional forces acting on the strap, to prevent relative movement between the overlapping strap end portions when the tension force on the strap is less than or equal to a selected, predetermined tension force. The crimp engagement functions to at least initially restrain the strap inner end portion 51 relative to the seal 60 while the press 30 is still closed about the bale 10. However, the degree of frictional force engagement is sufficiently low, in combination with other frictional forces acting on the strap, to permit relative movement between the overlapping strap end portions when the tension force on the strap exceeds the predetermined tension force. This is accomplished by the appropriate selection of seal material and formation of the crimp shapes as described above under appropriate deformation forces. The predetermined tension force at which the strap inner end portion 51 slips relative to the seal 60 (and relative to the strap outer end portion 52) is selected at some level below which the either the strap or seal is first in danger of catastrophically failing. Preferably, this predetermined tension force is greater than the tension forces normally imposed upon the straps 20 in a large percentage of the bales that are tied with the straps 20.

For example, in the United States of America, only about ten percent of the Universal Density bales produced may impose a load in excess of about 2500 pounds on each strap (where the bale is tied with six 0.75 inch wide straps spaced along the bale as illustrated in FIG. 1.) Thus, the novel seal and strap configuration disclosed herein can be designed to permit the strap inner end portion 51 to slip when the imposed tension force exceeds 2500 pounds per strap. In those ten percent of the bales where the 2500 pound force is exceeded, the strap inner end portion 51 will slip some amount. The seal may be designed to permit strap slippage at other tension loads—the seal and deformation design being modified as necessary to accommodate the particular bale size, bale density, bale material, strap and seal materials, strap size, and seal size.

Initially, the seal 60 is applied to the strap 20 so that a length (say 3 to 6 inches) of the strap inner end portion 51 extends beyond the seal as indicated in dashed lines in FIG. 6. Opening of the press 30 permits the bale 10 to expand tightly against each strap 20 if the straps had been initially disposed somewhat loosely about the bale. In any case, opening of the press 30 permits the full expansion force of the bale to be imposed upon the straps 20. If the force imposed on any of the straps 20 exceeds the predetermined design tension force, the strap inner end portion 51 will slip relative to the strap outer end portion 52 (to the position illustrated in solid lines in FIG. 6). This will cause the strap loop 20 to become larger and thus allow the bale to expand slightly. As the bale 10 expands, the pressure will be reduced and the tension force imposed upon the strap 20 will cause no further movement of the strap inner end portion 51 when the imposed tension force on the strap is less than the combined frictional engagement forces acting on the strap.

The combined frictional engagement forces acting on the strap 20 arise from a number of sources. First, there is frictional engagement between the overlapping strap end portions 51 and 52 at the vertical side of the bale 10. The vertical sides of the bale 10 typically expand outwardly less than the horizontal sides of the bale 10 expand outwardly after the opening of a conventional high density cotton bale press.

Second, there is some frictional engagement between the confronting surfaces of the overlapping strap end portions 51 and 52 within the seal 60 per se. Third, there is some the frictional engagement between the bale outer surfaces and the strap inner surface 42 around the entire periphery of the bale. Fourth, there is the substantial frictional engagement between the seal legs 64 and the strap inner end portion 51. Taking these forces into account for a given size bale of known material at an initial compression density, one can select (1) a strap and seal having known frictional chracteristics and (2) the specific crimp engagement structure so as to permit the desired slippage when the tension force imposed upon the strap 20 exceeds a predetermined amount.

The slippage of the strap inner end portion 51 described above need not be particularly great. The strap and seal system can be designed so that the slippage of the strap, when subjected to the overload condition, will be about one inch or less. With a Universal Density cotton bale, a one inch slippage of the strap will result in an increase in the width and height of the bale of one half inch or less. Such a small amount of bale growth will not appreciably affect the final density of the bale after the press is opened. Even though the bale density does not significantly change when the strap 20 slips, the strap slippage is sufficient to reduce the strap loading (e.g., a 20 percent reduction in strap tension force) so as to prevent catastrophic failure of the strap and/or seal.

The capability of the novel structure described herein to accommodate initial expansion of a high density bale released from a press in a manner that reduces, or eliminates all together, the likelihood of catastrophic failure of the seal and strap is also useful in accommodating other loading conditions that may be imposed upon the strap. Specifically, during handling and transportation, the bale and strap may be subjected to transient impact loads or to other environmental loads. Such loads may affect only a portion of the bale and only some of the straps on the bale. However, since the straps can slip if the load exceeds the design load, such loads will be less likely to cause a catastrophic failure of the strap.

It has been found that the seal notcher mechanism of a conventional power strapping machine can be modified to provide the seal structure described above. Signode Corporation, the assignee of the present invention and located at 3600 West Lake Ave. Glenview, Ill. 60025 U.S.A., manufactures and sells a Model M361 power strapping machine which incorporates a seal notcher mechanism. The seal notcher mechanism, and a notched seal formed by such a mechanism, are illustrated and described in the "Operation And Safety Manual" for the Model M361 power strapping machine (catalog publication designation "E-186177 8/81-1500"). The seal illustrated on pages 11 and 12 of that publication is shown with three, spaced-apart notches along each side margin of the seal to provide an interlocking engagement of the seal with both of the overlapping strap portions. The three notches are formed by notcher plates along each side of the seal between four spaced-apart jaws arranged so that each notch is formed between two of the four jaws engaged with the seal.

The seal structure of the present invention may be formed by modifying the above-described seal notcher assembly. Specifically, three, rather than four, spaced-apart jaws are disposed along each side of the seal. Two, rather than three, notcher plates are provided between the jaws. However, the shape of the notcher plates is modified and the depth of the notcher plate engagement with the seal is reduced so that only the strap outer end portion 52 is notched along with the seal 60 and so that the seal legs 64 are merely crimped into engagement with the strap inner end portion 51 as explained above in detail.

From the foregoing, it will be observed that numerous and various modifications may be effected without the departing from the true spirit and scope of the novel concept of the invention. It is to be understood that no limitation with respect to the specific structure and method illustrated herein is intended or should be inferred. It is, of course, intended to cover by the appended claims all such modifications as fall within the scope of the claims.

What is claimed is:

1. In combination, the elements comprising: a bale of compressed resilient material; at least one strap with two oppositely facing major side surfaces having predetermined frictional characteristics disposed in a loop around the bale to overlap an inner end portion of the strap adjacent the bale with an outer end portion of the strap; and a seal deformed closed about both of said overlapping strap end portions with one part of said seal adjacent one of said overlapping strap end portions and with another part of said seal adjacent the other of said overlapping strap end portions, two spaced-apart regions of said one strap end portion being severed from the edge of the strap for a part of the strap width to define therebetween a deformable wall and said wall being offset from said one strap end portion to define a notch in said one strap end portion, said deformed closed seal including: (1) a seal wall offset from and relative to said one part of said seal adjacent said one strap end portion, said offset seal wall projecting into said notch in said one strap end portion to effect an interlocking engagement between said one part of said seal and said one strap end portion preventing withdrawal of said one strap end portion from said closed seal, and (2) a crimp of said other part of said seal against said other strap end portion with a predetermined degree of frictional force engagement which, in combination with other frictional forces acting on the strap, is sufficiently great to restrain said other strap end portion relative to said seal when the tension force on said strap is equal to or less than a predetermined tension force but which is sufficiently low to permit relative movement between said overlapping strap end portions when the tension force on said strap exceeds said predetermined tension force.

* * * * *